United States Patent [19]

Higgins

[11] 4,384,722

[45] May 24, 1983

[54] RAPID PACE WORD GAME

[76] Inventor: Robert W. Higgins, 7 Allison Ct., Hauppauge, N.Y. 11788

[21] Appl. No.: 370,452

[22] Filed: Apr. 21, 1982

[51] Int. Cl.[3] ..... A63F 3/00

[52] U.S. Cl. ..... 273/272; 273/280

[58] Field of Search ..... 273/272, 280, 282, 309, 273/287; D7/2

[56] References Cited

U.S. PATENT DOCUMENTS

| | | | |
|---|---|---|---|
| 1,980,637 | 11/1934 | Savory | 273/280 |
| 2,774,598 | 12/1956 | Strocco | 273/280 |
| 3,165,318 | 1/1965 | Lissandrello | 273/272 |
| 3,873,093 | 3/1975 | Beskrone | 273/272 |
| 3,899,176 | 8/1975 | Gregan | 273/287 |
| 4,316,612 | 2/1982 | Harder | 273/272 |
| 4,341,386 | 7/1982 | Kleva | 273/272 X |

OTHER PUBLICATIONS

Turntable Scrabble®—Revolving Board, Jun. 1963, Playthings Magazine, p. 9.

*Primary Examiner*—Harland S. Skogquist
*Attorney, Agent, or Firm*—Michael I. Kroll

[57] ABSTRACT

A rapid pace word game is provided and consists of a platform, a box affixed to the center of the platform, four playing boards each playing board affixed at the top edge to each top edge of the box and affixed at the bottom edge to the platform so that each playing board is at a set angle and played simultaneously by up to four players, a turntable affixed to the bottom of the platform placed on a flat surface for rotating the platform, a plurality of letter tiles with various score values whereby the letter tiles are used to make interlocking words vertically and horizontally when placed on each playing board giving a score to each player and four racks, each rack used by each player to hold seven letter tiles.

4 Claims, 4 Drawing Figures

RAPID PACE WORD GAME

BACKGROUND OF THE INVENTION

1. Field of Invention

The instant invention relates generally to word games and more specifically it relates to a rapid pace word game for two to four players.

SUMMARY OF THE INVENTION

The rapid pace word game consists of a platform, a box, four playing boards, a rotatable turntable, a plurality of letter tiles and four racks.

A principle object of the present invention is to provide a rapid pace word game that each player plays at the same time so that there is no waiting.

Another object is to provide a rapid pace word game that provides four different playing boards.

An additional object is to provide a rapid pace word game that does not assign a particular playing board to a player but rather each player plays all the playing boards being used.

A further object is to provide a rapid pace word game that has playing boards designed similar to a crossword puzzle.

A further object is to provide a rapid pace word game that has rotatable playing boards so that each player can use a different playing board at different times during the game.

A still further object is to provide a rapid pace word game that is fast moving, fun and easy to use.

Further objects of the invention will appear as the description proceeds.

DESCRIPTION OF THE PREFERRED EMBODIMENTS

Figure 1:
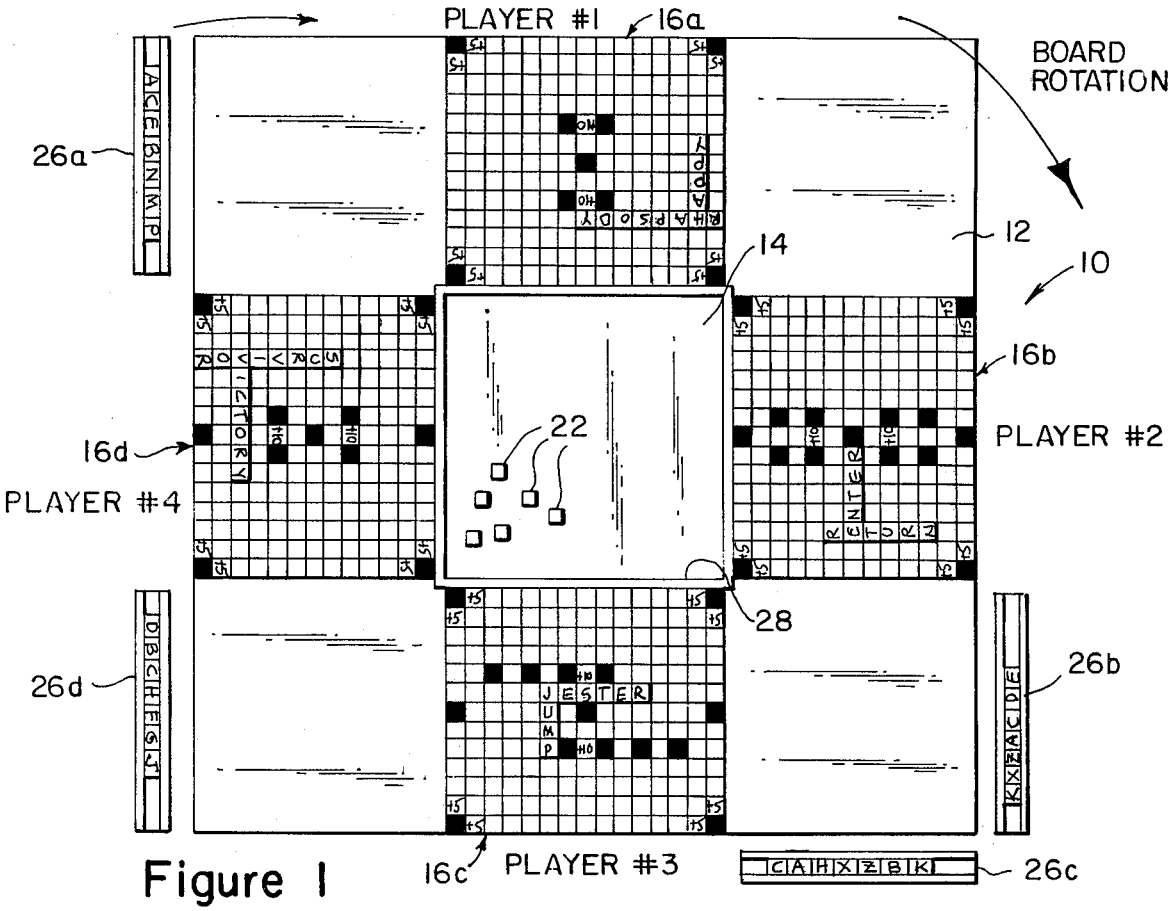
FIG. 1 is a top view of the invention.
Figure 2:
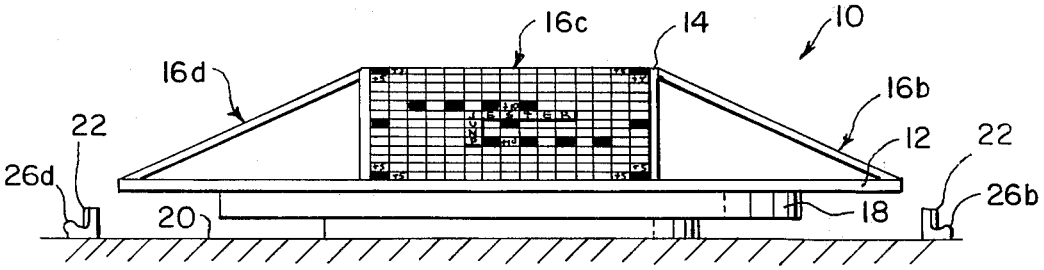
FIG. 2 is a side view of the invention.

Turning now descriptively to the drawings, in which similar reference characters denote similar elements throughout the several views, FIGS. 1 and 2 illustrates a rapid pace word game 10. The game 10 consists of a platform 12 and a box 14 affixed to the center of the platform 12. Four playing boards 16*a*, 16*b*, 16*c*, and 16*d* are used in the game 10. Each of the playing boards 16*a*, 16*b*, 16*c*, and 16*d* are affixed at the top edge to each top edge of the box 14 and affixed at the bottom edge to the platform 12 so that each playing board 16*a*, 16*b*, 16*c*, and 16*d* is at a set angle (see FIG. 2) and played simultaneously by up to four players.

A turntable 18 is affixed to the bottom of the platform 12 and placed on a flat surface 20 such as a table. The turntable 18 is for rotating the platform when the game 10 is played. A plurality of letter tiles 22 with various score values 24 are used to make interlocking words vertically and horizontally when placed on each playing board 16, 16*b*, 16*c*, and 16*d* giving a score to each player. Four racks 26*a*, 26*b*, 26*c*, and 26*d* are provided. Each rack is used by each player to hold seven letter tiles 22 when playing the game 10.

The box 14 has an open top 28 (see FIG. 1). The box 14 is used for storing the plurality of letter tiles 22 and the four racks 26*a*, 26*b*, 26*c*, and 26*d* when not in use.

Figure 3:
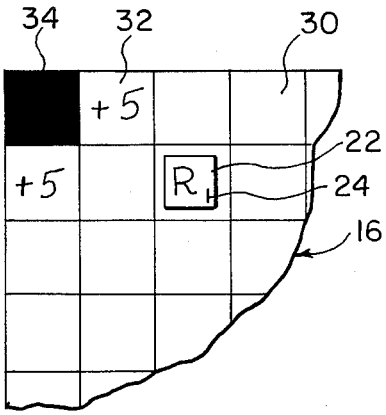
FIG. 3 is a partial detail view of a playing board with a letter tile on it.
Figure 4:
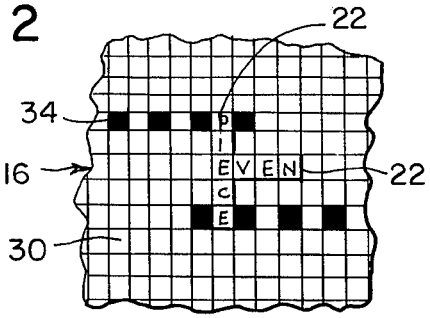
FIG. 4 is a partial top view of a playing board showing letter tiles making interlocking words.

As shown in FIG. 3 each playing board 16*a*, 16*b*, 16*c*, and 16*d* has a plurality of blank squares 30. Each blank square 30 can hold a letter tile 22. A plurality of bonus squares 32 are placed in different patterns on each playing board 16*a*, 16*b*, 16*c*, and 16*d*. A letter tile 22 can be put on a bonus square 32. This adds points as indicated on the bonus square 32 to each score of each player. A plurality of black squares 34 are placed in different patterns on each playing board 16*a*, 16*b*, 16*c*, and 16*d*. A letter tile 22 is not placed on the black squares 34 whereby a different combination of black squares 34 can make different playing boards 16*a*, 16*b*, 16*c*, and 16*d*.

There are two hundred letter tiles 22 with various point values included in the game 10 and are as follows:

A—18
B—4
C—4
D—8
E—24
F—4
G—6
H—4
I—18
J—2
K—2
L—8
M—4
N—12
O—16
P—4
Q—2
R—12
S—8
T—12
U—8
V—4
W—4
X—2
Y—4
Z—2
Blanks 4

The rules for playing the rapid pace word game 10 are as follows:

1. From two to four players each pick seven letter tiles 22 that are faced down and places them on his rack 28.

2. The game 10 has four different playing boards 16 designed similar to a crossword puzzle.

3. Each player then simultaneously combines two or more letter tiles 22 to form a word and places them on a playing board 16.

4. Each player may start anywhere on the playing board 16 and does not have to start in the middle.

5. No letter tile 22 may be placed on a black square 34.

6. If a player places one of the letter tiles 22 on a bonus square 32 the amount is added to the total value of the word when covered.

7. All players complete their turn by counting and announcing their score.

8. They then pick as many letter tiles 22 as they have played always keeping a total of seven letter tiles 22 for the next play.

9. After each player has placed his word on the playing board 16 it is rotated clockwise a quarter revolution.

10. The next word is then placed on the playing board 16 and must interlock with the word that was previously placed.

11. Each player then forms new words on each new playing board 16.

12. The play continues until all letter tiles 22 have been picked and one player has used all his letter tiles 22 thus ending the game 10. However, each player must finish his last play.

13. Each player then subtracts the total point value on the letter tiles 22 left from the player's score.

While the form of apparatus herein described constitutes a preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. A rapid pace word game which comprises:

(a) a platform;

(b) a box affixed to center of said platform;

(c) a plurality of playing boards each of said playing boards affixed at top edge to each top edge of said box and affixed at bottom edge to said platform so that each said playing board is at a set angle and played simultaneously by a plurality of players;

(d) means for rotating said platform so that each said player can use a different said playing board at next play;

(e) a plurality of letter tiles with various score values whereby said letter tiles are used to make interlocking words vertically and horizontally when placed on each said playing board giving a score to each said player; and (f) a plurality of racks each of said racks used by each of said players to hold a plurality of letter tiles.

2. A rapid pace word game as recited in claim 1, wherein said box has an open top, said box is used for storing said plurality of letter tiles and said plurality of racks when not in use.

3. A rapid pace word game as recited in claim 2, wherein each said playing board further comprises:

(a) a plurality of blank squares each said blank square holds a said letter tile;

(b) a plurality of bonus squares each said bonus square holds a said letter tile and adds points indicated on said bonus square to each score of each said player; and (c) a plurality of black squares each said black square left open so that a said letter tile is not placed thereto whereby a different combination of said black squares can make different said playing boards.

4. A rapid pace word game as recited in claim 3, wherein said means for rotating said platform is a turntable affixed to bottom of said platform and placed on a flat surface.

* * * * *